US006727450B2

(12) United States Patent
Schaeffeler et al.

(10) Patent No.: US 6,727,450 B2
(45) Date of Patent: Apr. 27, 2004

(54) ELECTRIC SWITCH

(75) Inventors: Alois Schaeffeler, Spaichingen (DE); Alfons Steidle, Spaichingen (DE); Paul Leibinger, Rietheim-Weilheim (DE)

(73) Assignee: Marquardt GmbH, Rietheim-Weilheim (DE)

( * ) Notice: Subject to any disclaimer, the term of this patent is extended or adjusted under 35 U.S.C. 154(b) by 0 days.

(21) Appl. No.: 10/181,705

(22) PCT Filed: Jan. 19, 2001

(86) PCT No.: PCT/DE01/00216

§ 371 (c)(1),
(2), (4) Date: Jul. 22, 2002

(87) PCT Pub. No.: WO01/54153

PCT Pub. Date: Jul. 26, 2001

(65) Prior Publication Data

US 2003/0010617 A1 Jan. 16, 2003

(30) Foreign Application Priority Data

Jan. 22, 2000 (DE) ..... 100 02 696
Jan. 22, 2000 (DE) ..... 100 02 695

(51) Int. Cl.[7] ..... H01H 13/02
(52) U.S. Cl. ..... 200/522; 200/157
(58) Field of Search ..... 200/440, 424, 200/445, 446, 468, 469, 470, 501, 318.1, 318.2, 293.1, 332.2, 157, 522, 1 B, 38 C, 35 H, 34

(56) References Cited

U.S. PATENT DOCUMENTS 2,810,051 A * 10/1957 Johnson ..... 200/318
3,745,286 A * 7/1973 Sahrbacker ..... 200/522
3,777,092 A * 12/1973 Yeske ..... 200/337
4,061,895 A 12/1977 Hults
4,149,053 A * 4/1979 Long ..... 200/522
4,442,363 A 4/1984 Suzuki
5,012,057 A * 4/1991 Inuyama ..... 200/522
5,075,604 A * 12/1991 Crook et al. ..... 318/17
5,401,928 A * 3/1995 Kelley ..... 200/510
5,644,112 A 7/1997 Geiger et al.
6,469,268 B1 * 10/2002 Schaeffeler et al. ..... 200/522

FOREIGN PATENT DOCUMENTS

| | | |
|---|---|---|
| DE | Nr 383915 | 11/1921 |
| DE | Nr 410719 | 11/1923 |
| DE | 36 10 682 A | 10/1987 |
| DE | 31 26816 C2 | 1/1988 |
| DE | 36 38 952 A | 5/1988 |
| DE | 36 44546 C1 | 6/1988 |
| DE | 38 31 344 A | 3/1990 |
| DE | 41 28 990 A1 | 3/1993 |
| DE | 42 32 402 A | 3/1994 |
| DE | 199 30 558 A1 | 1/2000 |
| DE | 199 37 786 A1 | 2/2000 |

* cited by examiner

*Primary Examiner*—Lincoln Donovan
*Assistant Examiner*—Lisa Klaus
(74) *Attorney, Agent, or Firm*—Venable LLP; Robert Kinberg; Stuart I. Smith

(57) ABSTRACT

An electrical switch is provided having at least one contact system having a switching contact movable between two switch positions, an operating member that acts on the switching contact, a slide hinged on the operating member, and delay means operatively connected to the switching contact in at least one of the two switch positions. The delay means delaying movement of the switching contact, and being arranged in an extension of the slide. The delay means, the operating member and the slide are arranged on a same side of the contact system.

22 Claims, 5 Drawing Sheets

ELECTRIC SWITCH

BACKGROUND OF THE INVENTION

The invention relates to an electrical.

Electrical switches such as these are used in electrical handheld tools, such as drills, angle grinders, circular saws, routers, hedge trimmers or the like. In particular, these may be electrical tools which are operated using direct current. Furthermore, switches such as these can switch with a delay, for example for soft starting on switching on and/or for short-circuit braking of the electrical tool.

An electrical switch which is suitable for short-circuit braking of the electrical tool is known from German patent document DE 42 32 402 A1. This switch has at least one contact system, which has a switching contact which can move between a switched-off position and a switched-on position for switching, and a stationary contact which interacts with the switching contact in the switched-on position. An operating member which can be moved manually acts on the switching contact, for switching. Furthermore, the switch has a delay means, which is operatively connected to the switching contact in one switch position in order to delay the switching movement.

The delay means, which is designed in the form of a delay drum, is arranged in the immediate vicinity, underneath the contact system, in the housing of the switch. The operating member is located above the contact system, on the opposite side of the housing. The switch thus has a considerable size, which may be an impediment in view of the fact that the spatial conditions in electrical tools are often confined. Furthermore, the means for the operative connection between the delay drum and the switching contact has a complex design. The means is expensive to manufacture, and its assembly is complex. The influences of faults during operation of the switch cannot in all cases be precluded and, in particular, an undesirable delay can occur in the switching movement of the switching contact when switching to the other switch position, as well.

SUMMARY OF THE INVENTION

An object of the invention is to provide a switch which has a delay means which interacts with the switching contact, has a physically small size, and/or has a switching delay to the one switch position that is not susceptible to defects.

A particularly compact switch is created in that the delay means and the operating member are arranged on the same side of the contact system. A switch which operates particularly reliably is, alternatively or additionally, created such that the operative connection between the delay means and the switching contact is reduced during the switching movement of the switching contact to the other switch position, in particular to the switched-off position, such that the switching contact moves to the other switching position essentially without any delay.

In general, the contact system is arranged in a housing. Up to four contact systems, which are located one behind the other, are preferably located in the housing. By way of example, two of these contact systems are used for the voltage supply with soft starting when the electric motor of the electrical tool is switched on, the third contact system is used for short-circuiting the electric motor for braking of the electrical tool when the voltage supply is switched off, and the fourth contact system is used as a bridge for the full voltage supply for the electric motor in the electrical tool after completion of the soft starting.

The operating member can be mounted on the upper face of the housing such that it can move. In one embodiment, a slide, which is guided into the housing and acts on a carriage, is articulated on the operating member. The switching contact is mounted elastically on the carriage with the aid of an elastic means, for example by means of a compression spring. Furthermore, a first spring, which is used to produce a pressure point or pressure points for the switching movement and interacts with the housing, can be arranged on the carriage. In addition, a second spring, which interacts with the slide and assists a snap-action switching movement, can also be arranged. Furthermore, a third spring, which is used for resetting, may also be located on the slide.

In one development, a guide channel for the slide is located on the upper face of the housing. The delay means can then be arranged on the upper face in the housing, and in an extension of the guide channel. The delay means may be in the form of a delay drum. A housing attachment which, in particular has an approximately half-cylindrical shape, is preferably arranged on the upper face of the housing, for holding and providing a bearing for the delay drum.

In one refinement, the delay means has a cylindrical drum, which is filled with a viscous liquid, and a shaft, which is arranged in the cylindrical drum, so that the cylindrical drum can move in a damped manner relative to the shaft. One shaft end may project on one side out of the cylindrical drum. Furthermore, a tooth system can be fitted on the cylindrical drum, in particular in the form of a pinion on that side of the cylindrical drum which is opposite the shaft end. A transmission element can then be moved in a damped manner by the cylindrical drum in order to act on the switching contact by means of a mating tooth system.

In a further refinement, a sliding element, which acts against the elastic means for the bearing of the switching contact, is mounted in the carriage such that it can move. The transmission element can then be coupled to the sliding element such that the restraining force which is exerted by the delay means acts against the force which is exerted by the elastic means during the switching movement of the switching contact, in order to delay the switching movement.

In one development, the transmission element is in the form of an approximately circular annular element. A shaft stub can be arranged on the periphery of the annular element facing away from the sliding element and engages in a bearing point in the housing attachment in order to allow the annular element to rotate through an angle which is defined in particular by stops in the housing attachment. An attachment for coupling to the sliding element can be fitted, approximately opposite the shaft stub, on the periphery of the annular element.

As a further embodiment, it is possible to fit the mating tooth system in the manner of an internal tooth system on the annular element. By way of example, the internal tooth system may be approximately in the form of a circular section. The sliding element may have an approximately U-shaped holder, in which the attachment on the annular element engages. Furthermore, the switching contact and the sliding element may be arranged on that side of the carriage which faces away from the delay means. The U-shaped holder may project through an aperture in the carriage, on that side of the carriage which faces the delay means.

In a further refinement, the transmission element has two annular elements, which are separated from one another by approximately the height of the cylindrical drum for the delay means. A shaft stub is preferably in each case located on each annular element, in order to mount the transmission element in a respective associated bearing point in the housing attachment. However, an internal tooth system may be fitted only on that annular element which faces away from the shaft end of the delay means. The attachments may be in the form of a rod element which connects the two annular elements to one another. Finally, the rod element may have a reduction in its cross section approximately in the center, by means of which the rod element engages in the U-shaped holder on the sliding element.

Advantages which are achieved by the invention are, in particular, that, despite having a high performance, the electrical switch occupies only a small installation area in the electrical tool. The switch is thus particularly suitable for installation in slimline, ergonomically shaped, handles of electrical tools. Since the effectiveness of the delay means can be restricted to one switching direction, any arc which may occur when switching off the electrical tool is extinguished immediately, thus effectively preventing destruction of the contact system, and lengthening the life of the switch. The switch is thus suitable for high currents, in particular for direct-current applications as well. It is likewise possible to use the switch as a braking switch. The configuration of the transmission element, which provides the coupling between the delay means and the switching contact, means that, despite its compactness, the transmission element can travel through large angular intervals with little space being required. This once again advantageously ensures that even lengthy delay times can be set, as required. Finally, the switch also has a comparatively small number of individual parts, so that it can be produced at very low cost.

BRIEF DESCRIPTION OF THE DRAWINGS

Exemplary embodiments of the invention, together with various developments and refinements, are illustrated in the drawings, and will be described in more detail in the following text. In the figures.

DETAILED DESCRIPTION OF PREFERRED EMBODIMENTS

Figure 1:
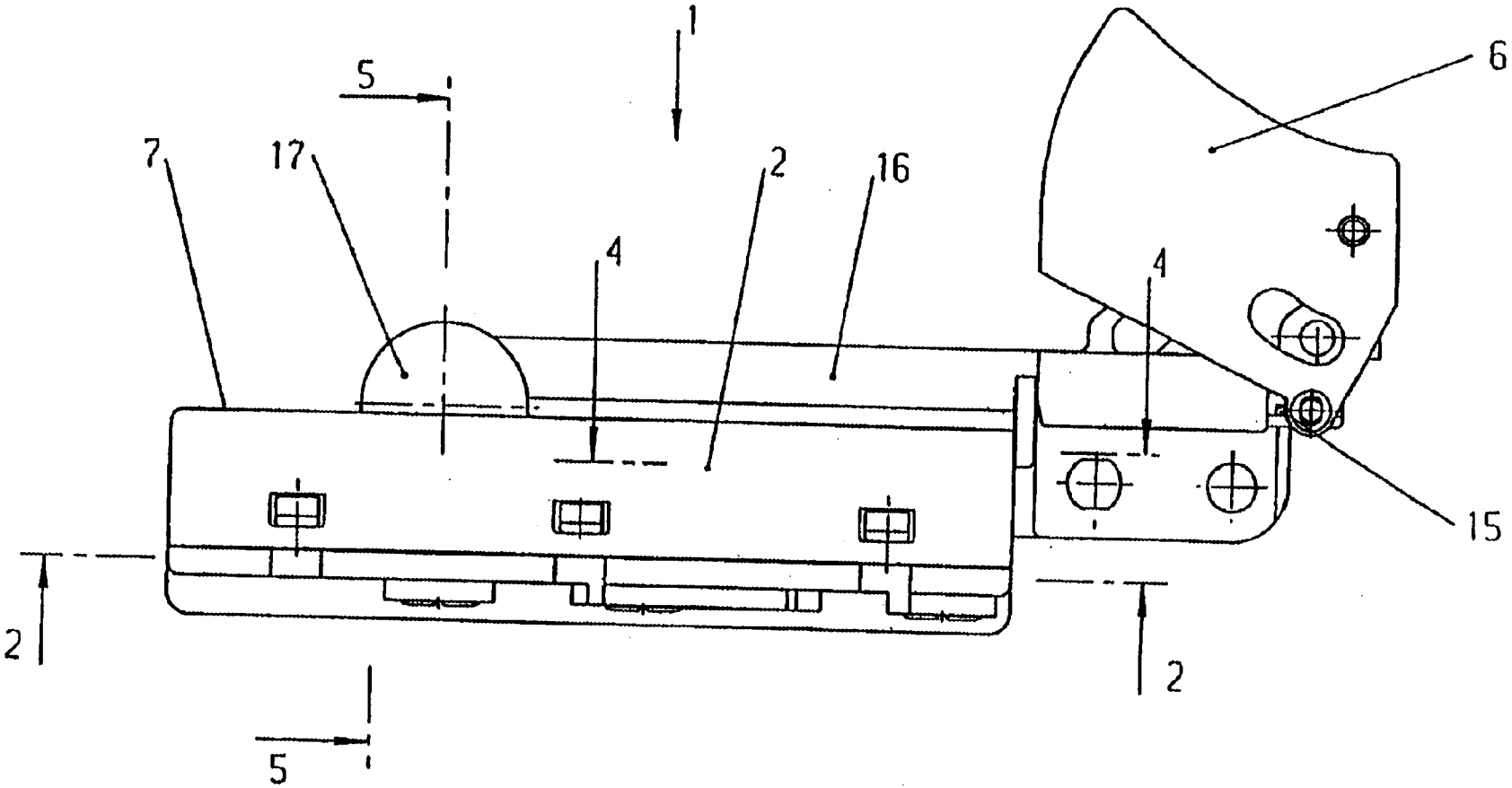
FIG. 1 shows a side view of an electrical switch.

FIG. 1 shows an electric switch 1, which is used in electrical handheld tools. The electrical tools may be drills, angle grinders, circular saws, routers, hedge trimmers or the like. In particular, the electrical switch 1 is especially suitable for powerful electrical tools, which are operated with direct current. Furthermore, the switch 1 is suitable for electrical tools which are equipped with soft starting and/or electrical short-circuit braking. The switch 1 has a housing 2, in which at least one contact system 3 is arranged. In the present case, there are a total of up to four contact systems 3, which are located one behind the other, in the housing 2, with these being annotated in more detail by the reference symbols 3*a*, 3*b*, 3*c*, 3*d* in FIG. 2. In this case, two contact systems 3*a*, 3*b* are used for the voltage supply for soft starting when the electric motor of the electrical tool is switched on. By way of example, a series resistor is connected into the voltage supply to the electric motor for soft starting. The fourth contact system 3*d* can be used to bridge the series resistor in order to produce the full supply voltage for the electric motor of the electrical tool once the soft starting has ended. Finally, the third contact system 3*c* short-circuits the electric motor of the electrical tool when the voltage supply is switched off, thus resulting in the electric motor being braked rapidly.

The contact system 3 has a switching contact 4, which can be moved between two switch positions, namely a switched-off position and a switched-on position, for switching, as well as a stationary contact 5. In the switched-on position, the switching contact 4 is located on the stationary contact 5, and interacts with it in order to close the electrical connection. In the switched-off position, the switching contact 4 is removed from the stationary contact 5, so that the electrical connection is broken.

In order to switch between the two switch positions, an operating member 6, which can be seen in FIG. 1, is mounted on the upper face 7 of the housing 2 such that it can move, and can thus be moved manually, acts on the switching contact 4. As can be seen in more detail from FIG. 3, a delay means 8 is also arranged in the housing 2 and is operatively connected to the switching contact 4, in at least one of the two switch positions, in order to delay the switching movement of the switching contact 4. In the present case, by way of example, the delay means 8 interacts with the switching contact 4 of the fourth contact system 3d in order to bridge the series resistor with a certain delay time, which is governed by the end of the soft starting of the electric motor.

According to the invention, the delay means 8 and the operating member 6 are now arranged on the same side of the contact system 3, to be precise on the upper face 7 of the housing 2. In consequence, the delay means 8 does not require any significant additional space in the switch 1, so that the switch 1 is particularly compact.

As an alternative/addition, the delay means 8 is operatively connected to the switching contact 4 such that it delays only the switching movement to the one switch position, to be precise during the switching movement to the switched-on position. In this case, the operative connection between the delay means 8 and the switching contact 4 during the switching movement of the switching contact 4 to the other switch position, to be precise during the switching movement of the switching contact 4 to the switched-off position, is in this case now reduced, such that the switching contact 4 moves to the other switch position essentially without any delay. Since there is no significant delay in switching off the switch 1, any arc which may occur is extinguished immediately, thus effectively preventing destruction of the contact system 3 of the switch 1. This alternative/supplementary refinement is particularly advantageous for a switch 1 for an electric tool which is operated by means of direct current for an electrical tool.

Various developments of the switch 1 according to the invention will be described in more detail in the following text.

Figure 2:
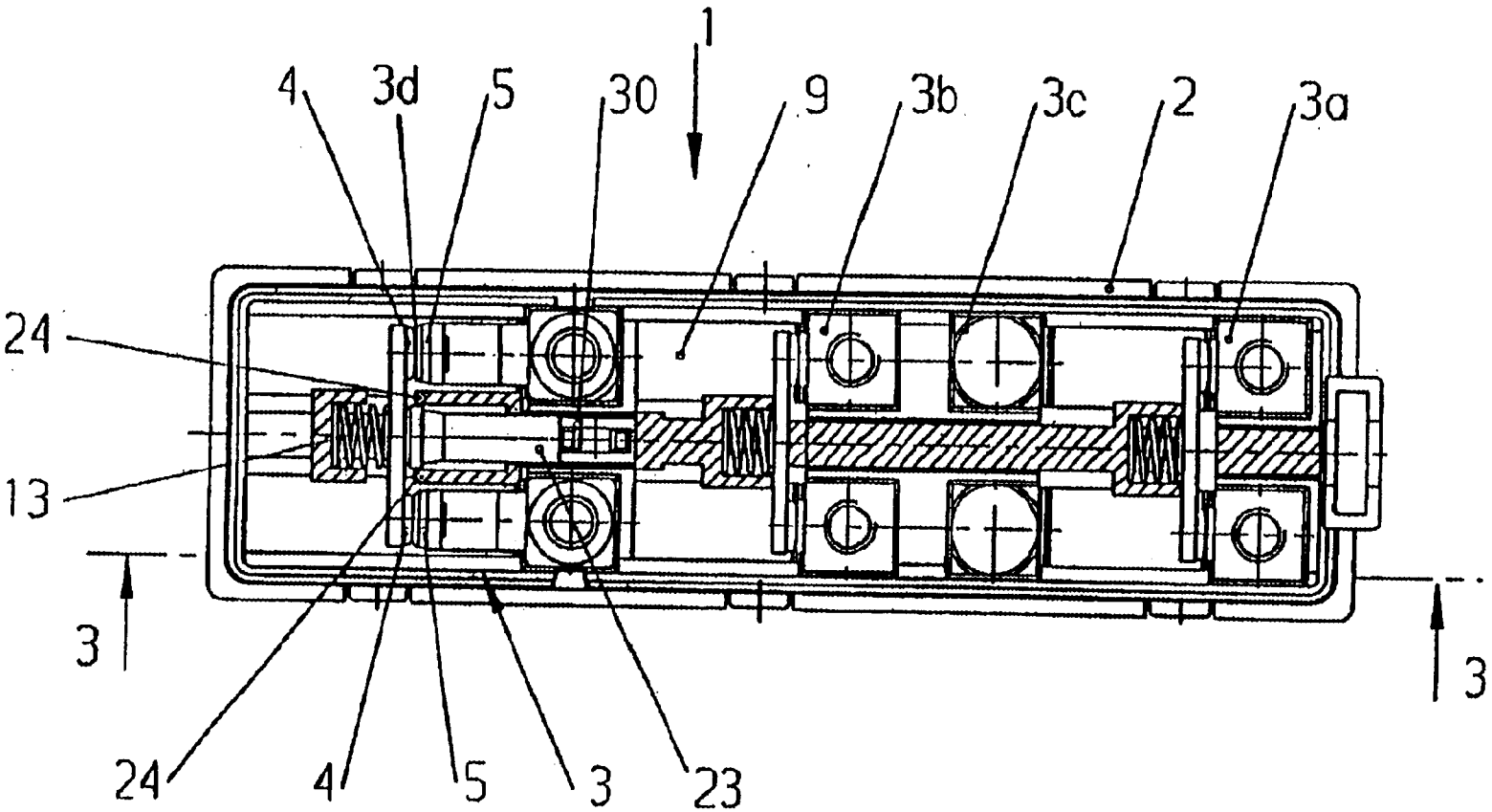
FIG. 2 shows a section along the line 2—2 in FIG. 1.

In the case of one such further refinement, in which context reference is also made to German Laid Open Specification DE 199 30 558 A1, which was not published prior to this, a carriage 9 is located in the housing 2, on whose lower face the switching contact 4 is mounted elastically with the aid of an elastic means, for example by means of a compression spring 13. The carriage 9 can be moved between two positions with the aid of a slide 15, which is guided into the housing 2, acts on the carriage 9 and is articulated on the operating member 6. When the carriage 9 is in one position, the contact system 3 is then in the switched-off position, and when the carriage 9 is in the other position, the contact system 3 is in the switched-on position. The switching contact 4 is preferably in the form of a contact link, by which means it bridges two respectively associated stationary contacts 5 in the switched-on position, as can be seen in FIG. 2.

Figure 3:
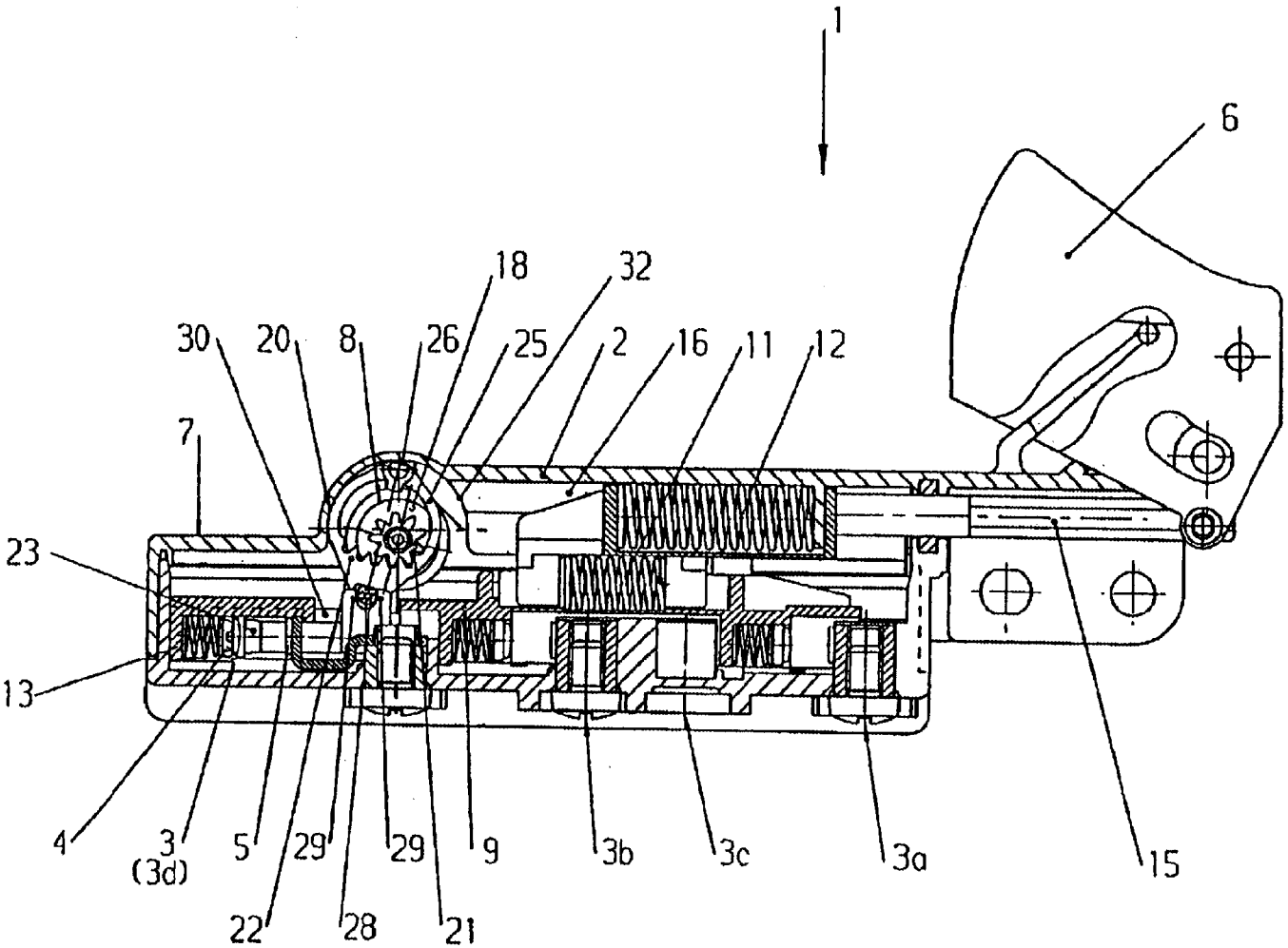
FIG. 3 shows a section along the line 3—3 in FIG. 2.
Figure 4:
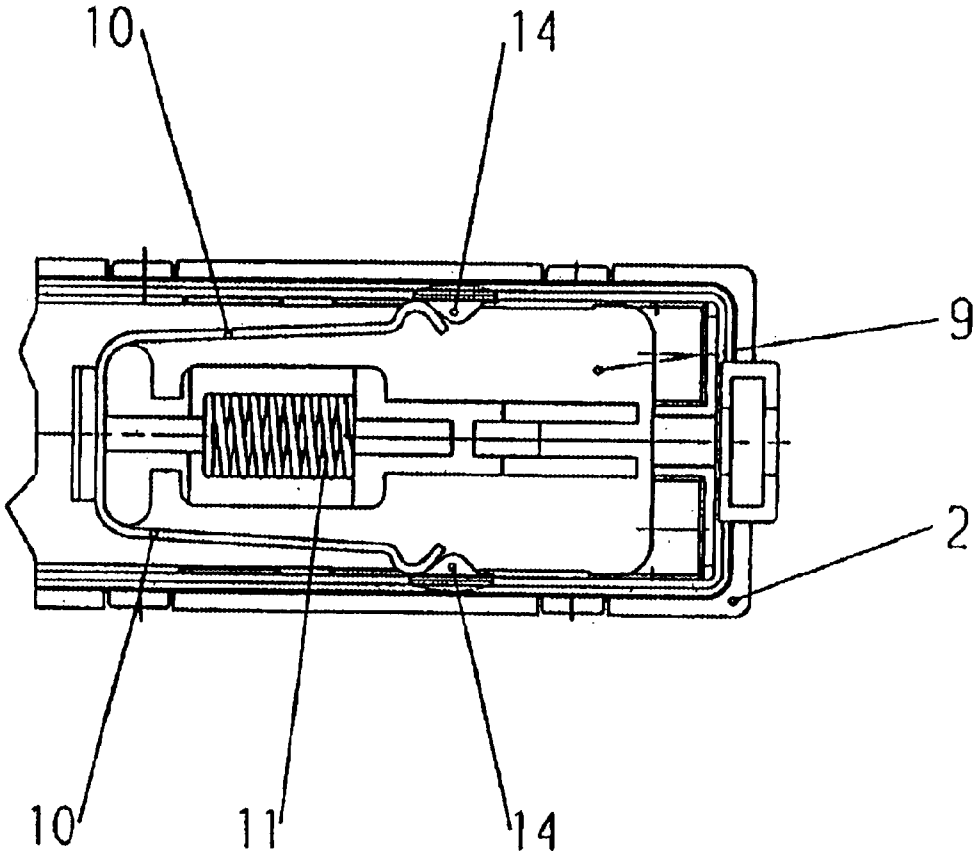
FIG. 4 shows a detail along the line 4—4 in FIG. 1.

As can be seen in more detail in FIG. 4, a first spring 10 is arranged on the carriage 9, in the form of a pressure-point spring. A switching point link 14, which is associated with the first spring 10 is located in the housing 2. During the movement of the carriage 9 which is produced via the slide 15 by operation of the operating member 6, the first spring 10 now interacts with the switching point link 14, which is stationary with respect to the carriage 9, in the sense of producing a pressure point or pressure points, such that a spring force acts in the opposite direction to the movement direction of the carriage 9, until the switching point is reached, when the pressure point is overcome. After passing through the switching point, the stored spring energy in the first spring 10 is released, so that the carriage 9 can be switched between its two switch positions with a snap-action movement. A further, second spring 11 is arranged on the carriage 9 and produces an additional spring force during switching, and during movement of the carriage 9. This additional spring force acts against the movement direction of the carriage 9 until the switching point is reached. On passing the switching point, this further spring force then acts in the same direction as the movement direction of the carriage 9, thus assisting the snap-action movement of the carriage 9. Finally, a third spring 12 is located on the slide 15, as is shown in FIG. 3, and this is used for resetting from the switched-on position to the switched-off position.

In a further refinement, as can be seen in FIG. 1, a guide channel 16 for the slide 15 is located on the upper face 7 of the housing 2. This then makes it possible for the delay means 8 to be arranged on the upper face 7 in the housing 2, to be precise expediently in an extension of the guide channel 16. It the delay means 8 is in the form of a delay drum, then a housing attachment 17, which has an approximately half-cylindrical shape, can be provided on the upper face 7 of the housing 2, for holding, and as a bearing of, the delay drum.

Figure 5:
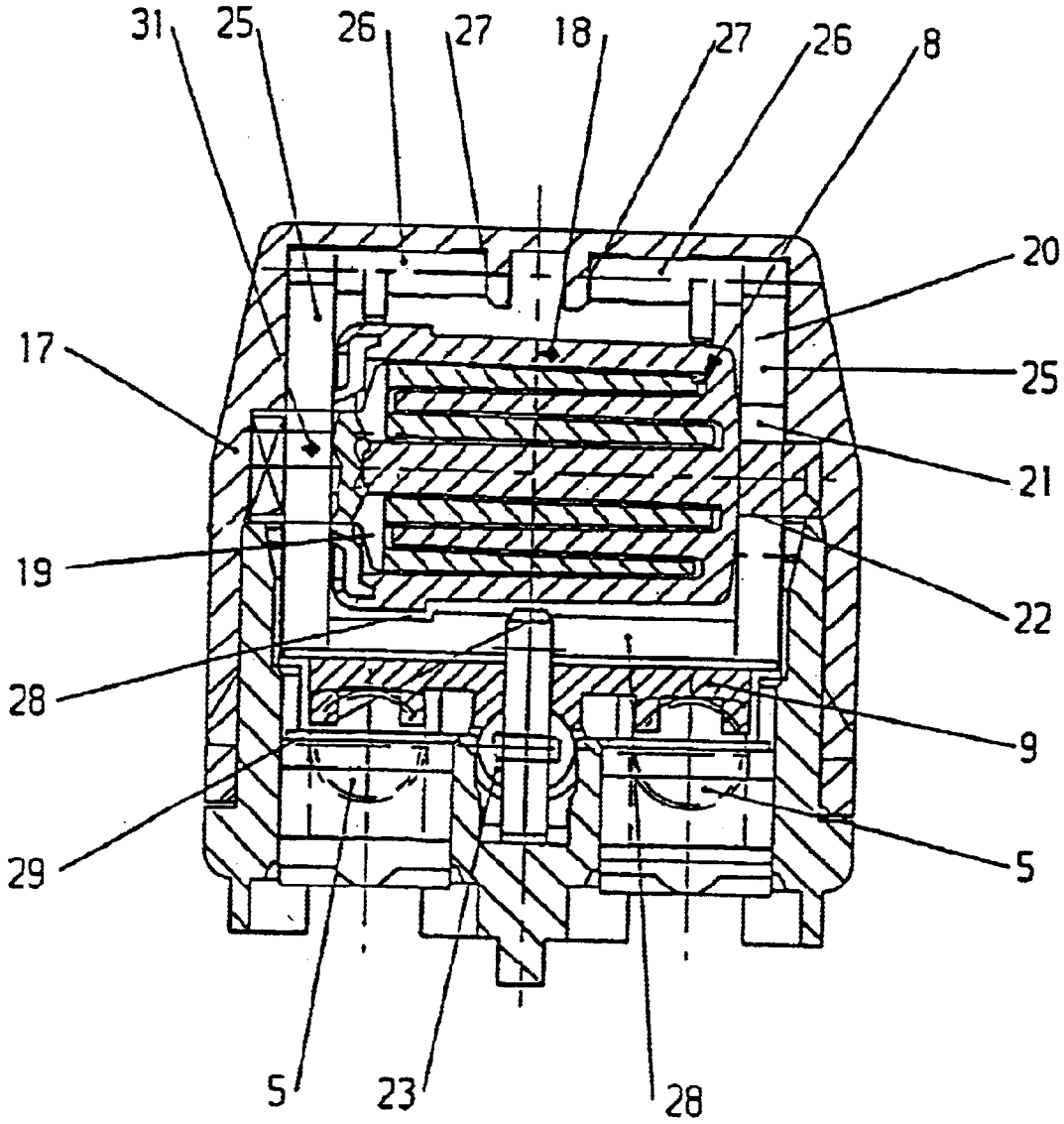
FIG. 5 shows a section along the line 5—5 in FIG. 1.

As can be seen in FIG. 5, the delay means 8, which is in the form of a delay drum, has a cylindrical drum 18, which is filled with a viscous liquid, and a shaft 19, which is arranged in the cylindrical drum 18. The cylindrical drum 18 can thus be moved in a damped manner relative to the shaft 19. One shaft end 31 of the shaft 19 projects out of the cylindrical drum 18 on one side, so that the shaft end 31 is used as a bearing for the delay means 8 in the housing attachment 17. A tooth system 21, to be precise in the form of a pinion, is fitted on the cylindrical drum 18, on that side of the cylindrical drum 18 which is opposite the shaft end 31. A transmission element 20, which can be moved in a damped manner by the cylindrical drum 18 by means of a mating tooth system 22, is used to influence the switching contact 4, in order in this way to switch the switching contact 4 with a delay time. The delay time is governed firstly by the viscosity of the liquid in the cylindrical drum 18, and secondly also by the transmission ratio of the tooth system 21 and of the mating tooth system 22, as well as by the size of the lever arm produced by the transmission element 20. The refinement including the tooth system 21 with the mating tooth system 22, results in the transmission element 20 moving through large angular intervals despite the small height of the transmission element 20, as is required for a physically small switch 1.

This furthermore results in the capability to produce greater delay times, as well. For example, a delay time from a few hundred milliseconds up to several seconds may be chosen for the switching-on delay for soft starting of the electrical tool.

A sliding element 23, which acts against the compression spring 13 which is used as the elastic means for the bearing of the switching contact 4 is mounted in the carriage 9 such that it can move, as can be seen in more detail from FIG. 3. The transmission element 20 is coupled to the sliding element 23 such that the restraining force which is exerted by the delay means 8 acts on the compression spring 13. This restraining force acts against the force which is exerted by the compression spring 13 on the switching contact 4 in the direction of the stationary contact 5. In consequence, when the switching contact 4 is being moved for switching purposes in the direction of the switched-on position, this switching movement is delayed, since only the forces from the compression spring 13 and the delay means 8 act on the switching contact 4. Conversely, however, when the switching contact 4 is being moved in the direction of the switched-off position for switching purposes, the resetting force from the third spring 12, possibly as well as from the first and second springs 10, 11, acts directly on the switching contact 4 via a stop 24, which can be seen in FIG. 2, in the carriage 9, so that the delay means 8 cannot exert any restraining effect, and the switching contact 4 is moved essentially without any delay. The delay means 8 is thus effectively coupled to the movement sequence of the switching contact 4 during the movement to the switched-on position, and is essentially decoupled from the movement sequence of the switching contact 4 during the movement to the switched-off position.

In a further refinement, as can be seen in FIG. 1, a guide channel 16 for the slide 15 is located on the upper face 7 of the housing 2. This then makes it possible for the delay means 8 to be arranged on the upper face 7 in the housing 2, to be precise, expediently in an extension of the guide channel 16. If the delay means 8 is in the form of a delay drum, then a housing attachment 17, which has an approximately half-cylindrical shape, can be provided on the upper face 7 of the housing 2, for holding, and as a bearing of, the delay drum.

In one expedient embodiment, which can be seen in more detail in FIG. 3, the transmission element 20 is in the form of an approximately circular annular element 25. A shaft stub 26 is arranged on the periphery of the annular element 25, facing away from the sliding element 23, and engages in a bearing point 27, which is shown in FIG. 5, in the housing attachment 17, so that the annular element 25 can be rotated through a specific angle. This angle can be fixed by stops 32 in the housing attachment 17. An attachment 28 for coupling to the sliding element 23 is fitted on the periphery of the annular element 25, approximately opposite the shaft stub 26. The angle through which the annular element 25 can rotate governs the effectiveness of the coupling between the delay means 8 and the sliding element 23, by means of the transmission element 20 and the delay time.

The mating tooth system 22 is fitted to the annular element 25 in the form of an internal tooth system, to be precise as an internal tooth system with an approximately circular section. The sliding element 23 has an approximately U-shaped holder 29, in which the attachment 28 on the annular element 25 engages for coupling. The switching contact 4 and the sliding element 23 are arranged on that side of the carriage 9 which faces away from the delay means 8. In order to allow the coupling action to take place, the U-shaped holder 29 thus projects through an aperture 30 in the carriage 9, on that side of the carriage 9 which faces the delay means 8.

In a further refinement, which is shown in FIG. 5, the transmission element 20 has two annular elements 25, which are separated from one another by approximately the height of the cylindrical drum 18 for the delay means 8. A shaft stub 26 is in each case located on each annular element 25, in order to provide a bearing for the transmission element 20 in a respectively associated bearing point 27 in the housing attachment 17. An internal tooth system, as a mating tooth system 22, is fitted only on that annular element 25 which faces away from the shaft end 31 of the shaft 19 of the delay means 8. The attachments 28 are in the form of a rod element, which connects the two annular elements 25 to one another. The rod element has a reduction in its cross section, which is not shown in any more detail but by means of which the rod element engages in the U-shaped holder 29 on the sliding element 23, approximately in its center.

The invention is not restricted to the described and illustrated exemplary embodiment. In fact, it also covers all specialist developments within the scope of the idea of the invention. For example, the switch according to the invention may be used not only in electrical tools but also in electrical garden equipment, domestic electrical equipment, or the like.

What is claimed is:

1. An electrical switch, comprising:

at least one contact system having a switching contact movable between two switch positions;

an operating member that acts on the switching contact;

a slide hinged on the operating member; and delay means operatively connected to the switching contact in at least one of the two switch positions, the delay means delaying movement of the switching contact, and being arranged in an extension of the slide, wherein the delay means, the operating member and the slide are arranged on a same side of the contact system.

2. The electrical switch according to claim 1, wherein two contact systems of the at least one contact system are arranged in a housing and are used for a voltage supply with soft starting when an electric motor of an electrical tool is switched on, a third contact system being used for short-circuiting the electric motor to brake the electrical tool when the voltage supply is switched off, and a fourth contact system being used as a bridge for the full voltage supply for the electric motor of the electrical tool after completion of the soft starting process.

3. The electrical switch according to claim 1, wherein the operating member is mounted on an upper face of a housing such that it can move, the slide, which is guided into the housing and acts on a carriage, is preferably hinged on the operating member, and the switching contact is elastically mounted on the carriage with aid of an elastic means.

4. The electrical switch according to claim 3, wherein a first spring, which is used to produce at least one pressure point for the switching movement and interacts with the housing and a second spring, which interacts with the slide and assists a snap-action switching movement, are arranged on the carriage, and a third spring, which is used for resetting, is located on the slide.

5. The electrical switch according to claim 1, wherein a guide channel for the slide is located on an upper face of a housing, with the delay means being arranged on the upper face in the housing in an extension of a guide channel.

6. The electrical switch according to claim 1, wherein the delay means is in a form of a delay drum, and a housing attachment which is approximately half-cylindrical in shape, is arranged on an upper face of the housing, for holding and as a bearing for the delay drum.

7. The electrical switch according to claim 1, wherein the delay means has a cylindrical drum, which is filled with a viscous liquid, and a shaft, which is arranged in the cylindrical drum, such that the cylindrical drum can move in a damped manner relative to the shaft, one shaft end projects on one side out of the cylindrical drum, and a tooth system is fitted on the cylindrical drum in the form of a pinion on that side of the cylindrical drum which is opposite the shaft end, and a transmission element is movable in the damped manner by the cylindrical drum to act on the switching contact by means of a mating tooth system.

8. The electrical switch according to claim 7, wherein a sliding element, which acts against an elastic means for the bearing of the switching contact, is mounted in a carriage such that it can move, and the transmission element is preferably coupled to the sliding element such that the restraining force which is exerted by the delay means acts against the force which is exerted by the elastic means during the switching movement of the switching contact, to delay the switching movement.

9. The electrical switch according to claim 7, wherein the transmission element is in the form of an approximately circular annular element, a shaft stub is arranged on a periphery of the annular element facing away from the sliding element and engages in a bearing point in a housing attachment to allow the annular element to rotate through an angle which is defined in particular by stops in the housing attachment, and an attachment for coupling to the sliding element is fitted, substantially opposite the shaft stub, on the periphery of the annular element.

10. The electrical switch according to claim 9, wherein the mating tooth system is fitted in the manner of an internal tooth system on the annular element, in the form of an internal tooth system with approximately circular section, the sliding element preferably has an approximately U-shaped holder, in which the attachment on the annular element engages, the switching contact and the sliding element are arranged on that side of a carriage which faces away from the delay means, and the U-shaped holder projects through an aperture in the carriage on that side of the carriage which faces the delay means.

11. The electrical switch according to claim 7, wherein the transmission element has two annular elements which are separated from one another by a distance approximately equal to a height of the cylindrical drum for the delay means, a shaft stub for bearing the transmission element is preferably located in one associated bearing point in a housing attachment on each annular element, an internal tooth system is fitted only on that annular element which faces away from the shaft end of the delay means, the housing attachments are in a form of a rod element which connects the two annular elements to one another, and the rod element has a reduction in its cross section approximately in its center, by means of which the rod element engages in a U-shaped holder on the slide.

12. An electrical switch, comprising:

at least one contact system having a switching contact movable between a switched-off position and a switched-on position;

a stationary contact that interacts with the switching contact in the switched-on position; and delay means operatively connected to the switching contact in at least one of the switched-off position and the switched-on position, the delay means delaying movement of the switching contact to a first one of the switched-off position and the switched-on position, wherein the operative connection between the delay means and the switching contact is reduced during a switching movement of the switching contact to a second one of the switched-off position and the switched-on position such that the switching contact is moved to the second one of the switched-off position and the switched-on position essentially without delay.

13. The electrical switch according to claim 12, wherein two contact systems of the at least one contact system are arranged in a housing and are used for a voltage supply with soft starting when an electric motor of an electrical tool is switched on, a third contact system being used for short-circuiting the electric motor to brake the electrical tool when the voltage supply is switched off, and a fourth contact system being used as a bridge for the full voltage supply for the electric motor of the electrical tool after completion of the soft starting process.

14. The electrical switch according to claim 12, wherein an operating member is mounted on an upper face of a housing such that it can move, a slide, which is guided into the housing and acts on a carriage, is preferably hinged on the operating member, and the switching contact is elastically mounted on the carriage with aid of an elastic means.

15. The electrical switch according to claim 14, wherein a first spring, which is used to produce at least one pressure point for the switching movement and interacts with the housing and a second spring, which interacts with the slide and assists a snap-action switching movement, are arranged on the carriage, and a third spring, which is used for resetting, is located on the slide.

16. The electrical switch according to claim 14, wherein a guide channel for the slide is located on an upper face of the housing, with the delay means being arranged on the upper face in the housing in an extension of a guide channel.

17. The electrical switch according to claim 14, wherein the delay means is in a form of a delay drum, and a housing attachment which is approximately half-cylindrical in shape, is arranged on an upper face of the housing, for holding and as a bearing for the delay drum.

18. The electrical switch according to claim 14, wherein the delay means has a cylindrical drum, which is filled with a viscous liquid, and a shaft, which is arranged in the cylindrical drum, such that the cylindrical drum can move in a damped manner relative to the shaft, one shaft end projects on one side out of the cylindrical drum, and a tooth system is fitted on the cylindrical drum in a form of a pinion on that side of the cylindrical drum which is opposite the shaft end, and a transmission element is movable in the damped manner by the cylindrical drum to act on the switching contact by means of a mating tooth system.

19. The electrical switch according to claim 18, wherein a sliding element, which acts against an elastic means for a bearing of the switching contact, is mounted in the carriage such that it can move, and the transmission element is preferably coupled to the sliding element such that a restraining force which is exerted by the delay means acts against the force which is exerted by the elastic means during the switching movement of the switching contact, in order to delay the switching movement.

20. The electrical switch according to claim 18, wherein the transmission element is in the form of an approximately circular annular element, a shaft stub is arranged on a periphery of the annular element facing away from the slide and engages in a bearing point in a housing attachment in order to allow the annular element to rotate through an angle which is defined in particular by stops in the housing attachment, and an attachment for coupling to the sliding element is fitted, substantially opposite the shaft stub, on the periphery of the annular element.

21. The electrical switch according to claim 20, wherein the mating tooth system is fitted in the manner of an internal tooth system on the annular element, in the form of an internal tooth system with approximately circular section, the sliding element preferably has an approximately U-shaped holder, in which the attachment on the annular element engages, the switching contact and the sliding element are arranged on that side of the carriage which faces away from the delay means, and the U-shaped holder projects through an aperture in the carriage on a side of the carriage which faces the delay means.

22. The electrical switch according to claim 18, wherein the transmission element has two annular elements which are separated from one another by a distance substantially equal to a height of the cylindrical drum for the delay means, a shaft stub for bearing the transmission element is preferably located in one associated bearing point in the housing attachment on each annular element, an internal tooth system is fitted only on that annular element which faces away from the shaft end of the delay means, the attachments are in a form of a rod element which connects the two annular elements to one another, and the rod element has a reduction in its cross section approximately in its center, by means of which the rod element engages in a U-shaped holder on the sliding element.

* * * * *